United States Patent [19]

Atal

[11] Patent Number: 4,701,954

[45] Date of Patent: Oct. 20, 1987

[54] MULTIPULSE LPC SPEECH PROCESSING ARRANGEMENT

[75] Inventor: Bishnu S. Atal, New Providence, N.J.

[73] Assignee: American Telephone and Telegraph Company, AT&T Bell Laboratories, Murray Hill, N.J.

[21] Appl. No.: 590,228

[22] Filed: Mar. 16, 1984

[51] Int. Cl.[4] ..... G10L 5/00

[52] U.S. Cl. ..... 381/49

[58] Field of Search ..... 381/29–40, 381/49, 50, 51; 364/513.5; 375/122

[56] References Cited

U.S. PATENT DOCUMENTS

| | | | |
|---|---|---|---|
| 3,582,546 | 6/1969 | Brown | 381/31 |
| 3,624,302 | 11/1971 | Atal | 179/1 SA |
| 3,631,520 | 12/1971 | Atal | 179/1 SA |
| 3,750,024 | 7/1973 | Dann et al. | 381/31 |
| 4,022,974 | 5/1977 | Kohut et al. | 364/513.5 |
| 4,130,729 | 12/1978 | Gagnon | 381/30 |
| 4,133,976 | 1/1979 | Atal | 179/1 P |
| 4,304,964 | 12/1981 | Wiggins, Jr. et al. | 381/51 |
| 4,472,832 | 9/1984 | Atal et al. | 381/40 |

OTHER PUBLICATIONS

"A New Model of LPC Excitation for Producing Natural-Sounding Speech at Low Bit Rates", *Proceedings of the International Conference on Acoustics Speech and Signal Processing*, B. S. Atal and J. R. Remde, 1982, pp. 614–617.

Kortman, C. M., "Redundancy Reduction—A Practical Method of Data Compression", Proceedings of the IEEE, vol. 55, No. 3, Mar. 1967.

*Primary Examiner*—E. S. Matt Kemeny

*Attorney, Agent, or Firm*—Jack S. Cubert

[57] ABSTRACT

A multipulse-code approximation of of one frame of a predictive residual signal may lose the frame-to-frame redundancy. Accordingly, pitch redundancy removal during the iterative process of forming the multipulse sequence, rather than frame-to-frame code comparison, provides reduction of excitation signal bit rate, substantially independent of voice pitch. A speech pattern predictive coding arrangement includes forming a prescribed format multipulse excitation signal for each successive time frame of the pattern. The multipulse excitation signal corresponds to the frame predictive residual. The redundancy in the multipulse excitation signal is reduced by forming a signal representative of the similarities between the current frame speech pattern and the speech pattern of preceding frames and removing such similarities from the multipulse excitation signal. Advantageously, the bit rate of the multipulse excitation signal is reduced and the excitation signal is rendered substantially independent of voice pitch.

6 Claims, 6 Drawing Figures

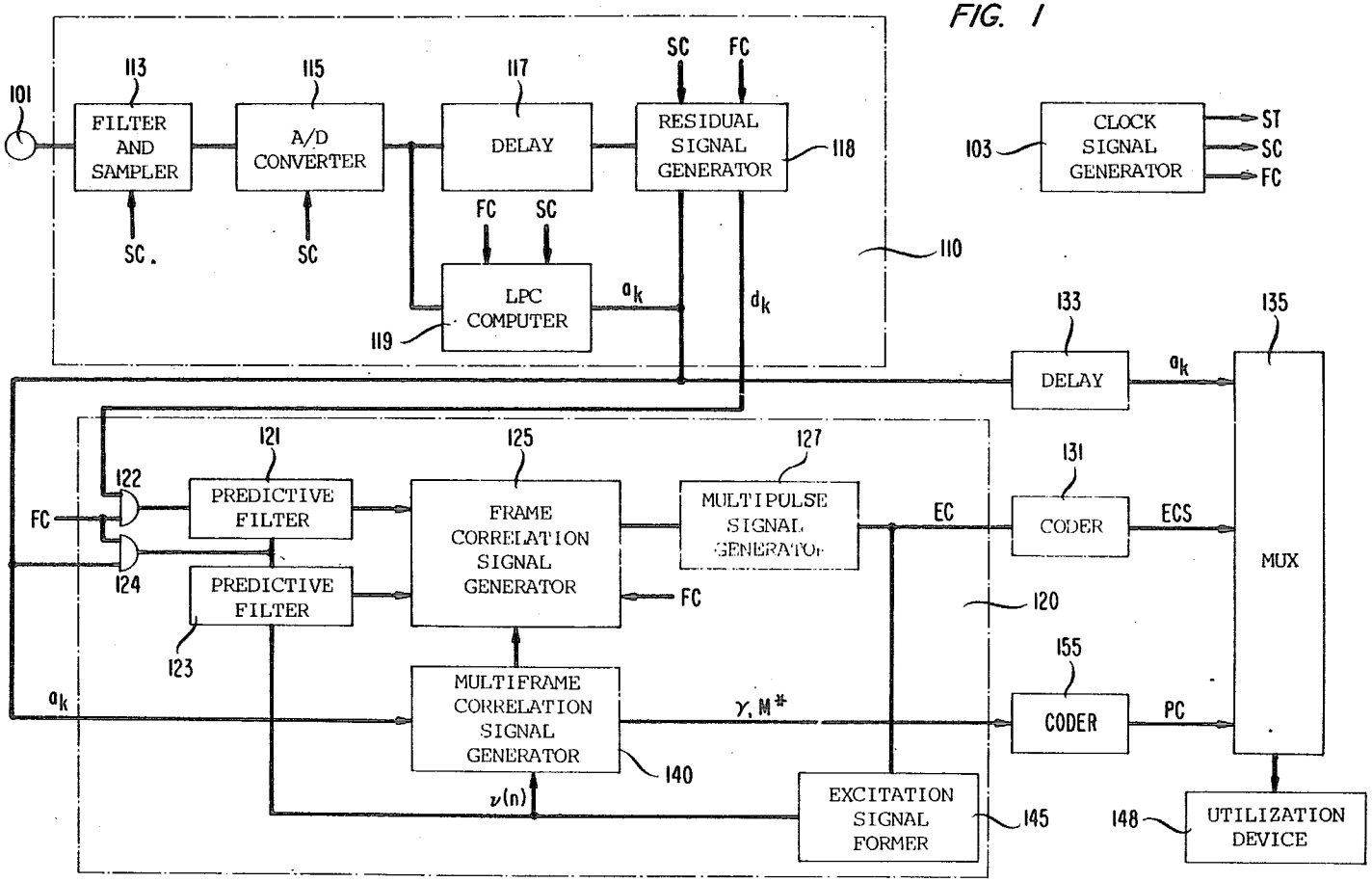
FIG. 1
CLOCK SIGNAL GENERATOR
ST
SC
FC
103
110
RESIDUAL SIGNAL GENERATOR
118
DELAY
117
A/D CONVERTER
115
FILTER AND SAMPLER
113
LPC COMPUTER
119
101
MUX
135
DELAY
133
CODER
131
CODER
155
UTILIZATION DEVICE
148
EXCITATION SIGNAL FORMER
145
MULTIPULSE SIGNAL GENERATOR
127
FRAME CORRELATION SIGNAL GENERATOR
125
MULTIFRAME CORRELATION SIGNAL GENERATOR
140
PREDICTIVE FILTER
121
PREDICTIVE FILTER
123
120
EC
ECS
PC
FC
SC
$d_k$
$a_k$
$\gamma, M^*$
$\nu(n)$
122
124

210
DATA MEMORY RAM
230
INPUT OUTPUT INTERFACE
260
225
CONTROLLER INTERFACE
220
CENTRAL PROCESSOR
240
ARITHMETIC PROCESSOR
250
ST
FC
CONTROLLER
215
STORE
218
PREDICTIVE FILTER PROCESSING ROM
201
FRAME CORRELATION SIGNAL PROCESSING ROM
217
MULTIFRAME CORRELATION PROCESSING ROM
212
EXCITATION SIGNAL PROCESSING ROM
205
$\beta_i$
$m_i$
$\gamma$
$M^*$
$a_k$
$d_k$ FIG. 4
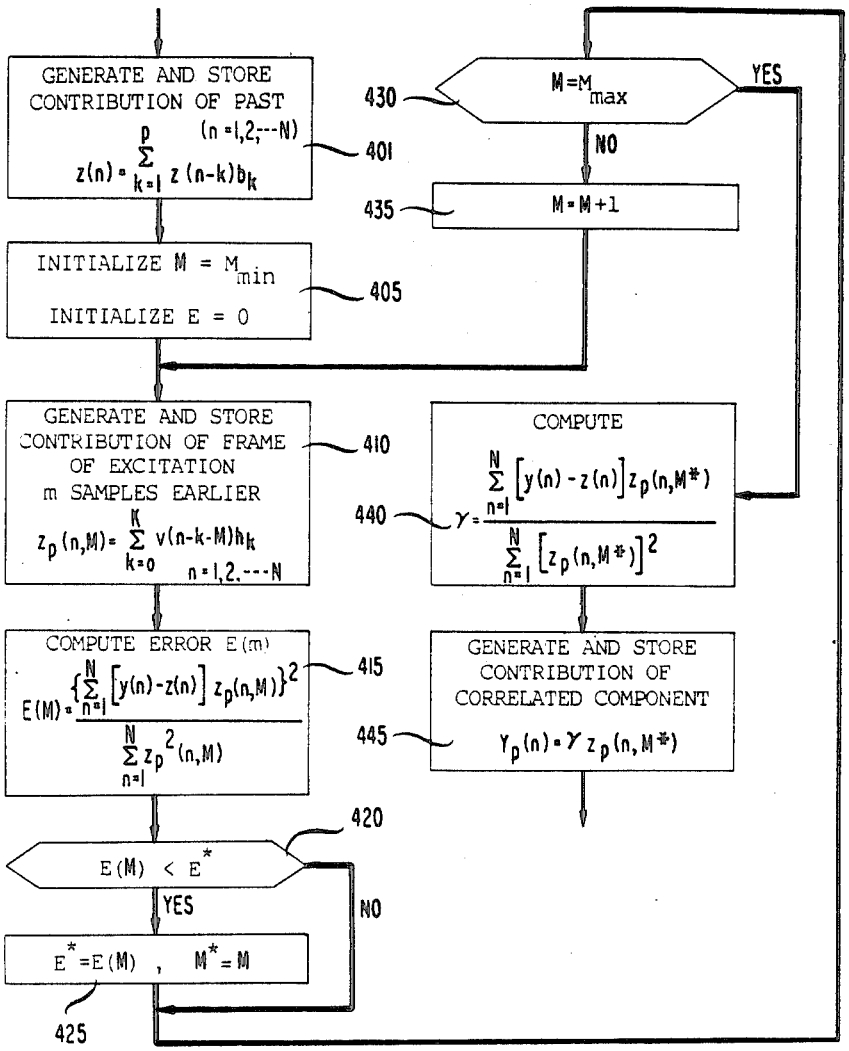
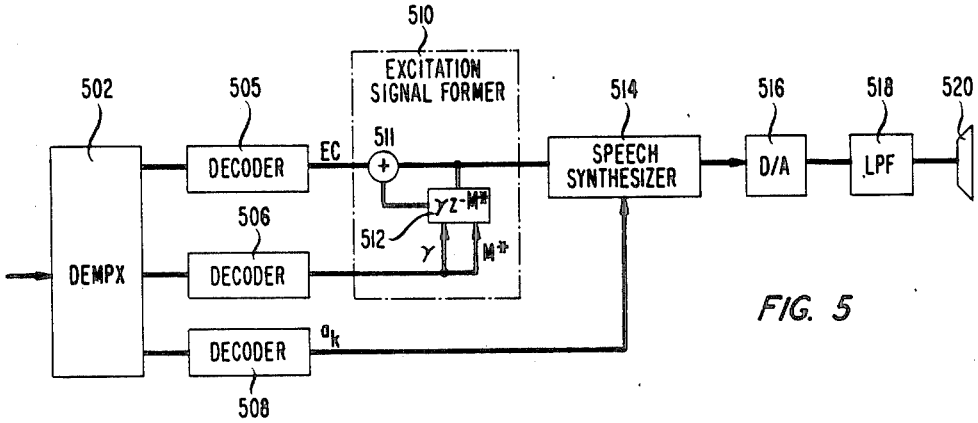
FIG. 5

MULTIPULSE LPC SPEECH PROCESSING ARRANGEMENT

This invention relates to speech analysis and more particularly to linear prediction speech pattern analyzers.

Linear predictive coding (LPC) is used extensively in digital speech transmission, speech recognition and speech synthesis systems which must operate at low bit rates. The efficiency of LPC arrangements results from the encoding of the speech information rather than the speech signal itself. The speech information corresponds to the shape of the vocal tract and its excitation and as is well known in the art, its bandwidth is substantially less than the bandwidth of the speech signal. The LPC coding technique partitions a speech pattern into a sequence of time frame intervals 5 to 20 milliseconds in duration. The speech signal is quasi-stationary during such time intervals and may be characterized by a relatively simple vocal tract model specified by a small number of parameters. For each time frame, a set of linear predictive parameters are generated which are representative of the spectral content of the speech pattern. Such parameters may be applied to a linear filter which models the human vocal tract along with signals representative of the vocal tract excitation to reconstruct a replica of the speech pattern. A system illustrative of such an arrangement is described in U.S. Pat. No. 3,624,302 issued to B. S. Atal, Nov. 30, 1971, and assigned to the same assignee.

Vocal tract excitation for LPC speech coding and speech synthesis systems may take the form of pitch period signals for voiced speech, noise signals for unvoiced speech and a voiced-unvoiced signal corresponding to the type of speech in each successive LPC frame. While this excitation signal arrangement is sufficient to produce a replica of a speech pattern at relatively low bit rates, the resulting replica has limited intelligibility. A significant improvement in speech quality is obtained by using a predictive residual excitation signal corresponding to the difference between the speech pattern of a frame and a speech pattern produced in response to the LPC parameters of the frame. The predictive residual, however, is noise-like since it corresponds to the unpredicted portion of the speech pattern. Consequently, a very high bit rate is needed for its representation. U.S. Pat. No. 3,631,520 issued to B. S. Atal, Dec. 28, 1971, and assigned to the same assignee discloses a speech coded system utilizing predictive residual excitation.

An arrangement that provides the high quality of predictive residual coding at a relatively low bit rate is disclosed in U.S. Pat. 4,472,832 issued to B. S. Atal et al Sept. 18, 1984 and assigned to the same assignee and in the article, "A new model of LPC excitation for producing natural sounding speech at low bit rates", appearing in the Proceedings of the International Conference on Acoustics, Speech and Signal Processing, Paris, France, 1982, pp. 614–617. As described therein, a signal corresponding to the speech pattern for a frame is generated as well as a signal representative of its LPC parameters responsive speech pattern for the frame. A prescribed format multipulse signal is formed for each successive LPC frame responsive to the differences between the frame speech pattern signal and the frame LPC derived speech pattern signal. Unlike the predictive residual excitation whose bit rate is not controlled, the bit rate of the multipulse excitation signal may be selected to conform to prescribed transmission and storage requirements. In contrast to the predictive vocoder type arrangement, intelligibility is improved, partially voiced intervals are accurately encoded and classification of voiced and unvoiced speech intervals is eliminated.

It has been observed that a multipulse excitation signal having approximately eight pulses per pitch period provides adequate speech quality at a bit rate substantially below that of the corresponding predictive residual. Speech pattern pitch, however, varies widely among individuals. More particularly, the pitch found in voices of children and adult females is generally much higher than the pitch for voices of adult males. As a result, the bit rate for multipulse excitation signals increases with voice pitch if high speech quality is to be maintained for all speakers. Thus, the bit rate in speech processing using multipulse excitation for adequate speech quality is a function of speaker pitch. It is an object of the invention to provide improved speech pattern coding with reduced excitation signal bit rate that is substantially independent of voice pitch.

BRIEF SUMMARY OF THE INVENTION

The foregoing object is achieved through removal of redundancy in the prescribed format multipulse excitation signal. A certain redundancy is found in all portions a speech pattern and is particularly evident in voiced portions of the speech pattern. Thus, signals indicative of excitation signal redundancy over several frames of speech may be coded and utilized to form a lower bit rate (redundancy reduced) excitation signal from the coded excitation signal. In forming a replica of the speech pattern, the redundancy indicative signals are combined with the redundancy reduced coded excitation signal to provide the appropriate excitation. Advantageously, the transmission facility bit rate and the coded speech storage requirements may be substantially reduced.

The invention is directed to a predictive speech pattern coding arrangement in which a speech pattern is sampled and the samples are partitioned into successive time frames. For each frame, a set of speech parameter signals are generated responsive to the frame sample signals and a signal representative of differences between the frame speech pattern and the speech parameter signal representative pattern is produced responsive to said frame predictive parameter signals and said frame speech pattern sample signals. A first signal is formed responsive to said frame speech parameter signals and said frame differences signal. A secnd signal is generated responsive to said frame speech parameter signals, and a third signal is produced that is representative of the similarities between the speech pattern of the frame and the speech pattern of preceding frames. Jointly responsive to the first, second and third signals, a prescribed format signal corresponding to the frame differences signal is formed. The second signal is modified responsive to said prescribed format signal.

According to one aspect of the invention the speech parameter signals are predictive parameter signals and the frame differences signal is a predictive residual signal.

According to another aspect of the invention, at least one signal corresponding to the frame to frame similarities is formed for each frame and a replica of the frame speech pattern is generated responsive to the prescribed format signal, the frame to frame similarity signals and the prediction parameter signals of the frame.

DESCRIPTION OF THE DRAWING

FIG. 1 depicts a block diagram of a speech coding arrangement illustrative of the invention;

FIGS. 3 and 4 show flow charts that illustrate the operation of the processing circuit of FIG. 2;

FIG. 5 shows a speech pattern synthesis arrangement that may be utilized as a decoder for the arrangement of FIG. 1.

DETAILED DESCRIPTION

Figure 2:
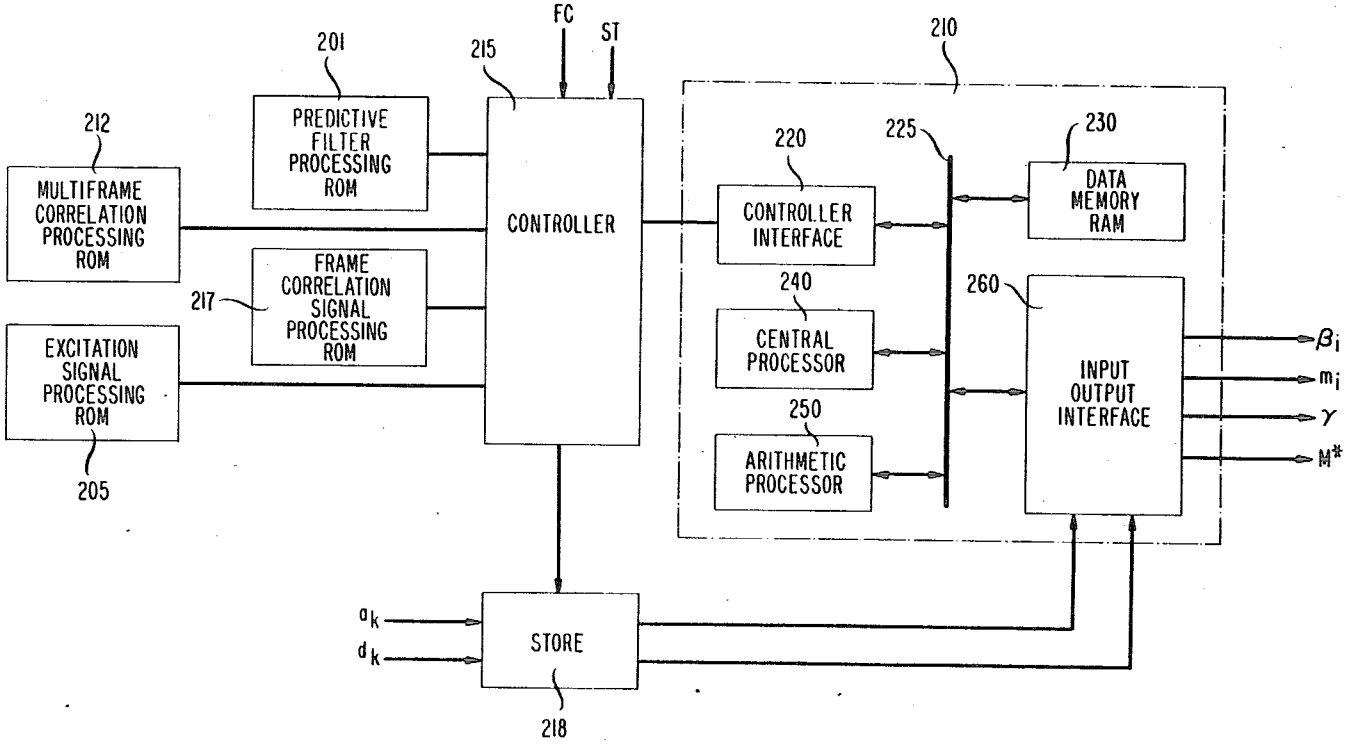
FIG. 2 depicts a block diagram of processing circuit arrangement that may be used in the arrangement of FIG. 1.

FIG. 1 depicts a general block diagram of a speech processor that illustrates the invention. In FIG. 1, a speech pattern such as a spoken message is received by microphone transducer 101. The corresponding analog speech signal therefrom is band-limited and converted into a sequence of pulse samples in filter and sampler circuit 113 of prediction analyzer 110. The filtering may be arranged to remove frequency components of the speech signal above 4.0 KHz and the sampling may be at an 8.0 KHz rate as is well known in the art. The timing of the samples is controlled by sample clock SC from clock generator 103. Each sample from circuit 113 is transformed into an amplitude representative digital code in analog-to-digital converter 115. The sequence of digitally coded speech samples is supplied to predictive parameter computer 119 which is operative, as is well known in the art, to partition the speech signals into 10 to 20 ms frame intervals and to generate a set of linear prediction coefficient signals $a_k, k=1,2, \ldots ,p$ representative of the predicted short time spectrum of the $N>>p$ speech samples of each frame. The speech samples from A/D converter 115 are delayed in delay 117 to allow time for the formation of speech parameter signals $a_k$. The delayed samples are supplied to the input of prediction residual generator 118. The prediction residual generator, as is well known in the art, is responsive to the delayed speech samples and the prediction parameters $a_k$ to form a signal corresponding to the differences therebetween. The formation of the predictive parameters and the prediction residual signal for each frame shown in predictive analyzer 110 may be performed according to the arrangement disclosed in U.S. Pat. No. 3,740,476 issued to B. S. Atal June 19, 1973, and assigned to the same assignee or in other arrangements well known in the art.

Figure 6:
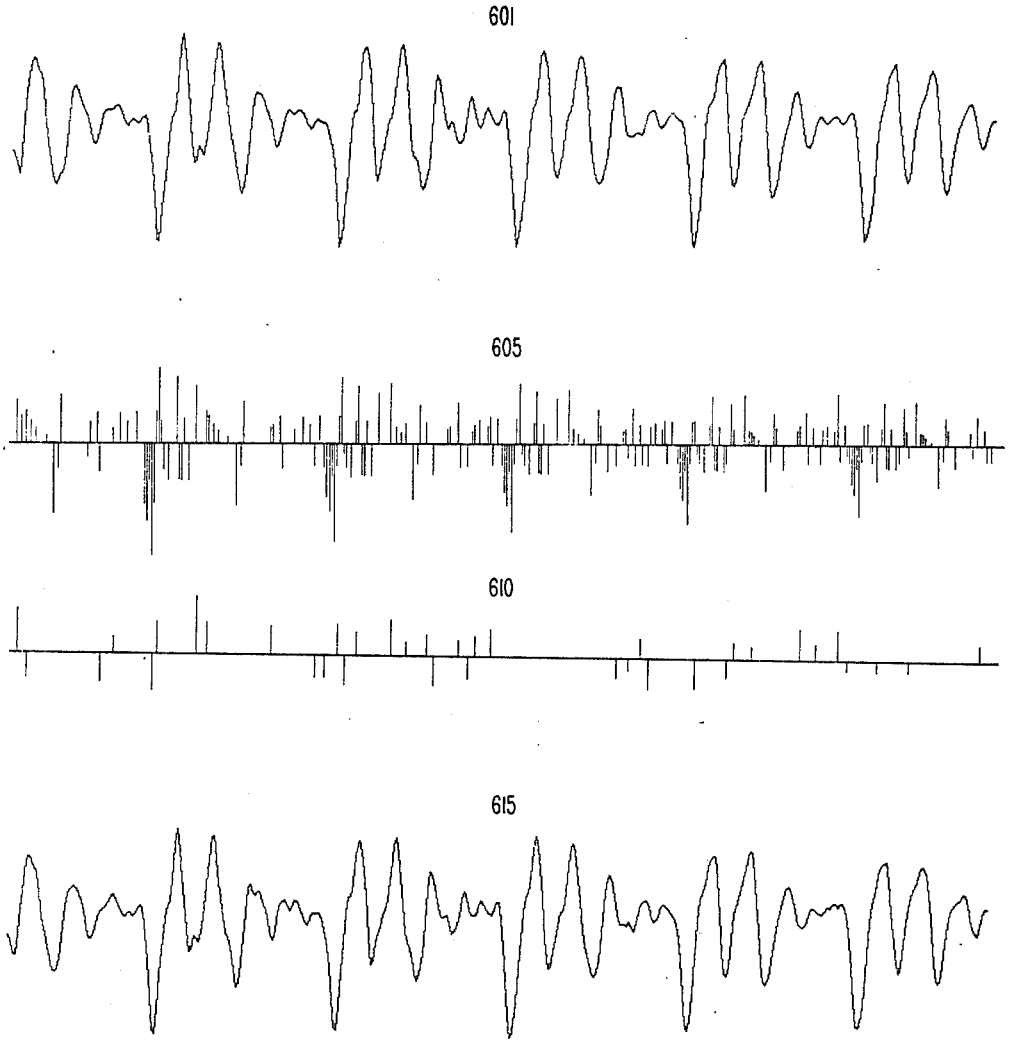
FIG. 6 shows waveforms illustrating the speech processing according to the invention.

While the predictive parameter signals $a_k$ form an efficient representation of the short time speech spectrum, the residual signal generally varies widely and rapidly over each interval and exhibits a high bit rate that is unsuitable for many applications. Waveform 601 of FIG. 6 illustrates a typical speech pattern over a plurality of frames. Waveform 605 shows the prescribed format multipulse excitation signal for the speech pattern of waveform 601 in accordance with the arrangements described in the aforementioned patent application and article. As a result of the invention, the similarities between the excitation signal of the current frame and the excitation signals of preceding frames are removed from the prescribed format multipulse signal of waveform 605. Consequently, the pitch dependence of the multipulse signal is eliminated and the amplitude range of the multipulse signal is substantially reduced. After processing in excitation signal forming circuit 120, the redundancy reduced multipulse signal of waveform 610 is obtained. A comparison between waveforms 605 and 610 illustrates the improvement that is achieved. Waveform 615 shows a replica of the pattern of waveform 601 obtained using the excitation signal of waveform 610, the redundancy parameter signals and the predictive parameter signals.

The prediction residual signal $d_k$ and the predictive parameter signals $a_k$ for each successive frame are applied from circuit 110 to excitation signal forming circuit 120 at the beginning of the succeeding frame. Circuit 120 is operative to produce a redundancy reduced multielement excitation code EC having a predetermined number of bit positions for each frame and a redundancy parameter code $\gamma$,M* for the frame. Each excitation code corresponds to a sequence of $1 \leqq i \leqq I$ pulses representative of the excitation function of the frame with multiframe redundancy removed to make it pitch insensitive. The amplitude $\beta_i$ and location $m_i$ of each pulse within the frame is determined in the excitation signal forming circuit as well as the $\gamma$ and M* redundancy parameter signals so as to permit construction of a replica of the frame speech signal from the excitation signal when combined with the redundancy parameter signals, and the predictive parameter signals of the frame. The $\beta_i$ and $m_i$ signals are encoded in coder 131. The $\gamma$ and M signals are encoded in coder 155. These excitation related signals are multiplexed with the delayed prediction parameter signals $a'_k$ of the frame in multiplexer 135 to provide a coded digital signal corresponding to the frame speech pattern.

In excitation signal forming circuit 120, the predictive residual signal $d_k$ and the predictive parameter signals $a_k$ of a frame are supplied to filter 121 via gates 122 and 124, respectively. At the beginning of each frame, frame clock signal FC opens gates 122 and 124 whereby the frame $d_k$ signal is applied to filter 121 and the frame $a_k$ signals are applied to filters 121 and 123. Filter 121 is adapted to modify signal $d_k$ so that the quantizing spectrum of the error signal is concentrated in the formant regions thereof. As disclosed in U.S. Pat. No. 4,133,976 issued to B. S. Atal et al, Jan. 9, 1979 and assigned to the same assignee, this filter arrangement is effective to mask the error in the high signal energy portions of the spectrum.

The transfer function of filter 121 is expressed in z transform notation as:

$$H(z) = \frac{1}{1 - B(z)} \tag{1}$$

where $$B(z) = \sum_{k=1}^{p} b_k z^{-k} \text{ and } b_k = \alpha^k a_k \tag{2}$$

$$k = 1, 2, \ldots p$$

and $$h_o = 1 \tag{3}$$

$$h_k = \sum_{i=1}^{\min(k-1,p)} b_k h_{k-i}$$

-continued $$k = 1, 2, \ldots, K$$

Predictive filter 123 receives the frame predictive parameter signals $a_k$ from computer 119 and an excitation signal v(n) corresponding to the prescribed format multipulse excitation signal EC from excitation signal former 145. Filter 123 has the transfer function of Equation 1. Filter 121 forms a weighted frame speech signal $\hat{y}$ responsive to the predictive residual $d_k$ while filter 123 generates a weighted predictive speech signal y responsive to the multipulse excitation signal being formed over the frame interval in multipulse signal generator 127. The output of filter 121 is $$y(n) = \sum_{k=n-K}^{n} d_k h_{n-k} \quad (4)$$

$$1 \leqq n \leqq N$$

where $d_k$ is the predictive residual signal from residual signal generator 118 and $h_{n-k}$ corresponds to the response of filter 121. The output of filter 123 is $$\hat{y}(n) = \sum_{j=1}^{i} \beta_j h_{n-mj} \quad (5)$$

$$1 \leqq n \leqq N$$

Signals y(n) and $\hat{y}$(n) are applied to frame correlation signal generator 125 and the current frame predictive parameters $a_k$ are applied to multiframe correlation signal generator 140.

Multiframe correlation signal generator 140 is operative to form a multiframe correlation component signal $y_p$(n) corresponding to the correlation of the speech pattern of the current frame to preceding frames, a signal z(n) corresponding to the contribution of preceding excitation of the current frame speech pattern, a current frame correlation parameter signal $\gamma$, and a current frame correlation location signal M*. Signal z(n) is formed from its past values responsive to linear prediction parameter signals $a_k$ in accordance with $$z(n) = \sum_{k=1}^{p} z(n-k) b_k \quad (6)$$

A range of samples $M_{min}$ to $M_{max}$ extending over a plurality of preceding frames is defined. A signal $$v(n) = \gamma v(n - M^*) + \sum_{i=1}^{I} \beta_i \gamma_{n-mi} \quad (6a)$$

representing the excitation of the preceding frame is produced from the proceeding frame prescribed format multipulse signal is produced. For each sample M in the range, a signal $$z_p(n,M) = \sum_{k=o}^{K} v(n-k-M) h_k \quad (6b)$$

$$n = 1, 2, \ldots, N$$

is formed corresponding to the contribution of the frame of excitation from m samples earlier. A signal $$E(\gamma,M) = \sum_{n=1}^{N} [y(n) - z(n) - \gamma(M) z_p(n,M)]^2 \quad (7)$$

corresponding to the difference between the current value of the speech pattern y(n) and the sum of the past excitation contribution to the present speech pattern value z(n) and the contribution of the correlated component from sample $\gamma y_p$(n)(M)z(n,M) may be formed. Equation 7 may be expressed as $$E(\gamma,M) = \sum_{n=1}^{N} [y(n) - z(n)]^2 - 2\gamma(M) \sum_{n=1}^{N} [y(n) - z(n)] z_p(n,M) + \gamma^2(M) \sum_{n=1}^{N} z_p^2(n,M) \quad (8)$$

By setting the derivative of E($\gamma$, M) with respect to $\gamma$(M) equal to zero, the value of $\gamma$ which minimizes E($\gamma$,M) is found to be $$\gamma(M) = \frac{\sum_{n=1}^{N} [y(n) - z(n)] z_p(n,m)}{\sum_{n=1}^{N} z_p^2(n,M)} \quad (9)$$

and the minimum value of E($\gamma$,M*) is determined by selecting the minimum signal E(M*) from $$E(M) = \sum_{n=1}^{N} [y(n) - z(n)]^2 - \frac{\left[\sum_{n=1}^{N} [y(n) - z(n)] z_p(n,m)\right]^2}{\sum_{n=1}^{N} z_p^2(n,M)} \quad (10)$$

over the range Mmin<=M<=Mmax. $\gamma$ can then be formed from equation 9 using the value of M* corresponding to the selected minimum signal E($\gamma$,M) as per Equation 10.

The multiframe correlated component of signal $$y_p(n) = \gamma(M^*) z_p(n,M^*) \quad (11)$$

is obtained from signals $\gamma$ and $z_p$(n,M*).

Signal $y_p$(n) is supplied to frame correlation signal generator 125 which is operative to generate signal $$C_{iq} = \sum_{n=q}^{N} y_n h_{n-q} - \sum_{n=q}^{N} \hat{y}_{i-1}(n) h_{n-q} - y_p(n) \quad (12)$$

where $$\hat{y}_{i-1}(n) = \sum_{j=1}^{i-1} \beta_j h_{n-mj} \quad (13)$$

responsive to signals y(n) from predictive filter 121, signal $\hat{y}$(n) from predictive filter 123 and signal $y_p$(n) from multiframe correlation signal generator 140. Signal $C_{iq}$ is representative of the weighted differences between signals y(n) and the combination of signals $\hat{y}$(n) and $y_p$(n). The effect of signal $y_p$(n) in processor 125 is to remove long term redundancy from the weighted differences. The long term redundancy is generally related to the pitch predictable component of the speech pattern. The output of frame correlation generator 125 represents the maximum value of $C_{iq}$ over the current frame and its location q*. Generator 127 produces a pulse of magnitude $$\beta_i = C_{iq}^*/\sum_{k=o}^{K} h_k^2 \quad (14)$$

and location $m_i = q^*$. The signals $\beta_i$ and $m_i$ are formed iteratively until I such pulses are generated by feedback of the pulses through excitation signal former 145.

In accordance with the invention, the output of processor 125 has reduced redundancy so that the resulting excitation code obtained from multipulse signal generator 127 has a smaller dynamic range. The smaller dynamic range is illustrated by comparing waveforms 605 and 610 in FIG. 6. Additionally, the removal of the pitch related component from the multipulse excitation code renders the excitation substantially independent of the pitch of the input speech pattern. Consequently, a significant reduction in excitation code bit rate is achieved.

Signal EC comprising the multipulse sequence $\beta_i$, $m_i$ is applied to multiplexor 135 via coder 131. The multipulse signal EC is also supplied to excitation signal former 145 in which an excitation signal v(n) corresponding to signal EC is produced. Signal v(n) modifies the signal formed in predictive filter 123 to adjust the excitation signal EC so that the differences between the weighted speech representative signal from filter 121 and the weighted artificial speech representative signal from filter 123 are reduced.

Multipulse signal generator 127 receives the $C_{iq}$ signals from frame correlation signal generator 127, selected the $C_{iq}$ signal having the maximum absolute vaue and $i^{th}$ element of the coded signal as per Equation 14. The index i is incremented to i+1 and signal $\hat{y}(n)$ at the output of predictive filter 123 is modified. The process in accordance with Equations 4, 5 and 6 is repeated to form element $\beta_{i+1}$, $m_{i+1}$. After the formation of element $\beta_I$, $m_I$, the signal having elements $\beta_1 m_1$, $\beta_2 m_2$, . . . , $\beta_I m_I$ is transferred to coder 131. As is well known in the art, coder 131 is operative to quantize the $\beta_i m_i$ elements and to form a coded signal suitable for transmission to utilization device 148.

Each of filters 121 and 123 in FIG. 1 may comprise a recursive filter of the type described in aforementioned U.S. Pat. No. 4,133,976. Each of generators 125, 127, and 140 as well as excitation signal former 145 may comprise one of the processor arrangements well known in the art adapted to perform the processing required by Equations 4 and 6 such as the C.S.P., Inc. Macro Arithmetic Processor System 100 or other processor arrangements well known in the art. Alternatively, the aforementioned C.S.P. system may be used to accomplish the processing required in all of these generating and forming units. Generator 140 includes a read only memory that permanently stores a set of instructions to perform the functions of Equations 9–11. Processor 125 includes a read-only memory which permanently stores programmed instructions to control the $C_{iq}$ signal formation in accordance with Equation 4. processor 127 includes a read-only memory which permanently stores programmed instructions to select the $\beta_i$, $m_i$ signal elements according to Equation 6 as is well known in the art. These read only memories may be selectively connected to a single processor arrangement of the type described as shown in FIG. 2. The program instructions for the signal processing in the circuit of FIG. 1 is set forth in FORTRAN language form in Appendix A hereto.

Figure 3:
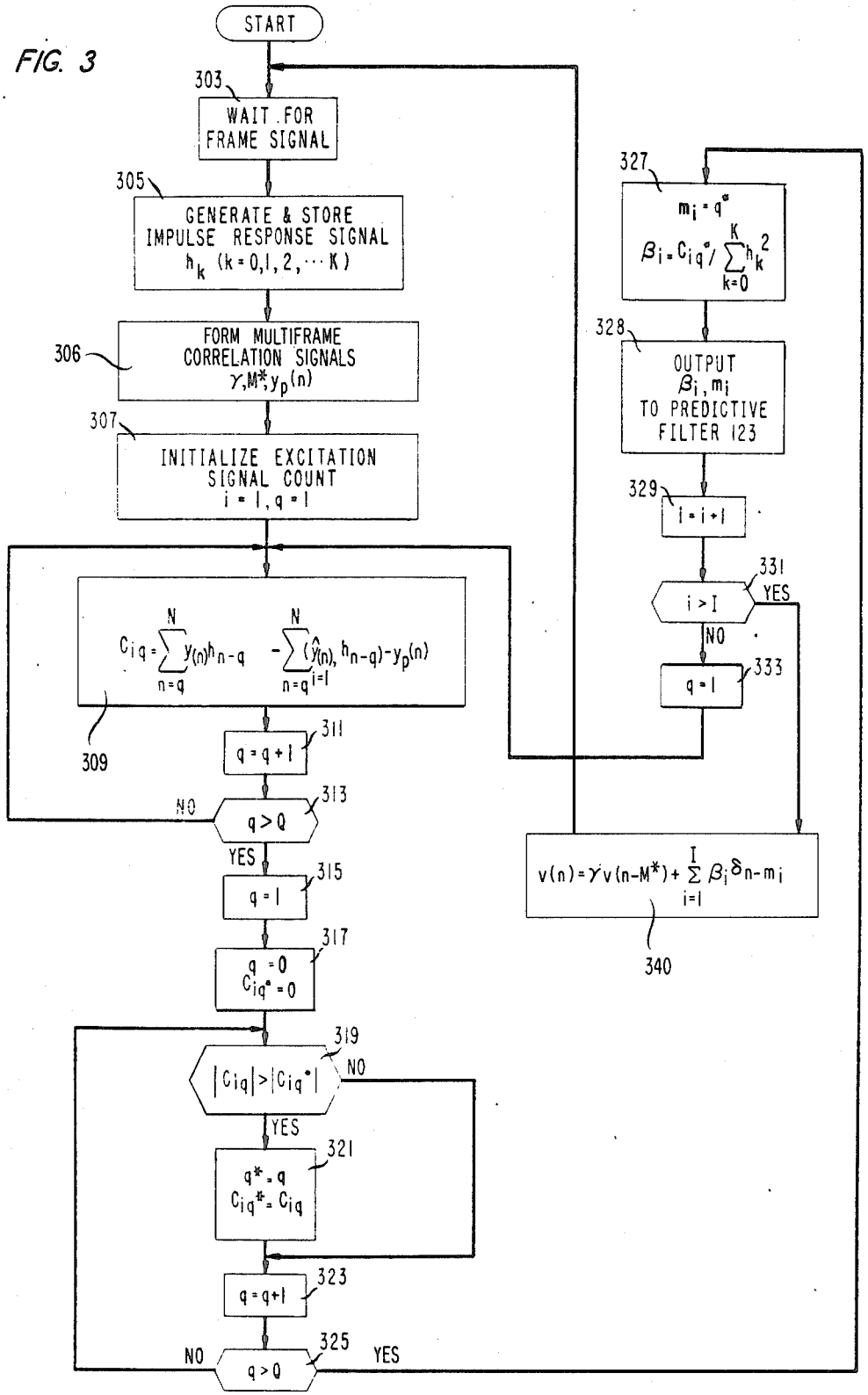

FIG. 3 depicts a flow chart showing the operations of signal generators 125, 127, 140, and 145 for each time frame. Referring to FIG. 3, the $h_k$ impulse response signals are generated in box 305 responsive to the frame predictive parameters $a_k$ in accordance with the transfer function of Equation 1. This occurs after receipt of the FC signal from clock 103 in FIG. 1 as per wait box 303. The generation of the multiframe correlation signal $y_p(n)$ and the multiframe correlation parameter signals $\gamma$ and M* is then performed in multiframe signal generator 140 as per box 306. The operations of box 306 are shown in greater detail in the flow chart of FIG. 4.

Referring to FIGS. 1 and 4, signal z(n) representative of the contribution of preceding excitation is generated (box 401) and stored in multiframe correlation signal generator 140 according to equation 1 responsive to the predictive parameter signals $a_k$. Index M is set to Mmin and minimum error signal E* is set to zero in box 405. The loop including boxes 410, 415, 420, 425, 430, and 435 is then iterated over the range Mmin<=M<=Mmax so that the minimum error signal E(m) and the location of the minimum error signal are determined. In box 410, the contribution of the preceding M samples to the excitation is generated as per Equation 6a and 6b. The error signal for the current frame is generated in box 415 and compared to the minimum error signal E* in decision box 420. If the current error signal is smaller than E*, E* is replaced (box 420), its location M becomes M* (box 425) and decision box 430 is reached. Otherwise, decision box 430 is entered directly from box 420. Sample index M is incremented (box 435) and the loop from box 410 to box 435 is iterated until sample Mmax is detected in box 430. When M=Mmax, correlation parameter $\gamma$ for the current frame is generated (box 440) in accordance with Equation 9 using sample M* and the multiframe correlation signal $y_p(n)$ is generated in box 445. Signals $\gamma$, M*, and $y_p(n)$ are stored in generator 440. The element index i and the excitation pulse location index q are initially set to 1 in box 307. Upon receipt of signals y(n) and $\hat{y}(n)$ from predictive filters 121 and 123, signal $C_{iq}$ is formed as per box 309. The location index q is incremented in box 311 and the formation of formation of the next location $C_{iq}$ signal is initiated.

After the $C_{iq}$ signal is formed for excitation signal element i in processor 125, processor 127 is activated. The q index in processor 127 is initially set to 1 in box 315 and the i index as well as the $C_{iq}$ signals formed in processor 125 are transferred to processor 127. Signal $C_{iq}^*$ which represents the $C_{iq}$ signal having the maximum absolute value and its location q* are set to zero in box 317. The absolute values of the $C_{iq}$ signals are compared to signal $C_{iq}^*$ and the maximum of these absolute values is stored as signal $C_{iq}^*$ in the loop including boxes 319, 321, 323, and 325.

After the $C_{iq}$ signal from processor 125 has been processed, box 327 is entered from box 325. The excitation code element location $m_i$ is set to q* and the magnitude of the excitation code element $\beta_i$ is generated in accordance with Equation 6. The $\beta_i m_i$ element is output to predictive filter 123 as per box 328 and index is incremented as per box 329. Upon formation of the $\beta_I m_I$ element of the frame, signal v(n) for the frame is generated as per Equation 6a (box 340) and wait box 303 is reentered. Processors 125 and 127 are then placed in wait states until the FC frame clock pulse of the next frame.

The excitation code in processor 127 is also supplied to code 131. The coder is operative to transform the excitation code from processor 127 into a form suitable for use in network 140. The prediction parameter signals $a_k$ for the frame are supplied to an input of multiplexer 135 via delay 133 as signals $a'_k$. The excitation coded signal ECS from coder 131 is applied to the other input of the multiplexer. The multiplexed excitation and predictive parameter codes for the frame are then sent to utilization device 148.

The data processing circuit depicted in FIG. 2 provides an alternative arrangement to excitation signal forming circuit 120 of FIG. 1. The circuit of FIG. 2 yields the excitation code $\beta_i$, $m_i$ for each frame of the speech pattern as well as the redundancy parameter signals for the frame $\gamma$, M* in response to the frame prediction residual signal $d_k$ and the frame prediction parameter signals $a_k$ in The circuit of FIG. 2 may comprise the previously mentioned C.S.P., Inc. Macro Arithmetic Processor System 100 or other processor arrangements well known in the art.

Referring to FIG. 2, processor 210 receives the predictive parameter signals $a_k$ and the prediction residual signals $d_k$ of each successive frame of the speech pattern from circuit 110 via store 218. The processor is operative to form the excitation code signal elements $\beta_1$ $m_1$, $\beta_2$, $m_2$, . . . , $\beta_I$, $m_I$, and redundancy parameter signals $\gamma$ and M* under control of permanently stored instructions in predictive filter processing subroutine read-only memory 201, multiframe correlation processing read-only memory 212, frame correlation signal processing read-only memory 217, and excitation processing read-only memory 205. The permanently stored instructions of these read-only memories are set forth in Appendix A.

Processor 210 comprises common bus 225, data memory 230, central processor 240, arithmetic processor 250, controller interface 220 and input-output interface 260. As is well known in the art, central processor 240 is adapted to control the sequence of operations of the other units of processor 210 responsive to coded instructions from controller 215. Arithmetic processor 250 is adapted to perform the arithmetic processing on coded signals from data memory 230 responsive to control signals from central processor 240. Data memory 230 stores signals as directed by central processor 240 and provides such signals to arithmetic processor 250 and input-output interface 260. Controller interface 220 provides a communication link for the program instructions in the read-only memories 201, 205, 212, and 217 to central processor 240 via controller 215, and input-output interface 260 permits the $d_k$ and $a_k$ signal to be supplied to data memory 230 and supplies output signals $\beta_i$, $m_i$, $\gamma$ and M* from the data memory to coders 131 and 155 in FIG. 1.

The operation of the circuit of FIG. 2 is illustrated in the flow charts of FIGS. 3 and 4. At the start of the speech signal, box 305 in FIG. 3 is entered via box 303 after signal ST is obtained from clock signal generator 103 in FIG. 1. The predictive filter impulse response for signals y(n) and $\hat{y}$(n) are formed as per box 305 in processors 240 and 250 under control of instructions from predictive filter processing ROM 201. Box 306 is then entered and the operations of the flow chart of FIG. 4 are carried out responsive to the instructions stored in ROM 212. These operations result in the formation of signals $y_p(n)$, $\gamma$, and M* and have been described with respect to FIG. 1. Signals $\gamma$ and M* are made available at the output of input-output interface 260 and signal $y_p(n)$ is stored in data memory 230.

Upon completion of the operations of box 306, Controller 215 connects frame correlation signal processing ROM 217 to central processor 240 via controller interface 220 and bus 225 so that the signals $C_{iq}$, $C_{iq}$*, and q* are formed as per the operations of boxes 307 through 325 for the current value of excitation signal index i. Excitation signal processing ROM 205 is then connected to computer 210 by controller 215 and the signals $\beta_i$ and $m_i$ are generated in boxes 327 through 333 as previously described with respect to FIG. 1. Signal v(n) is then produced for use in the next frame in box 340 as per equation 6a. The excitation signals are generated in serial fashion for i=1, 2, . . . , I in each frame. Upon completion of the operations of FIG. 3 for excitation signal $\beta_I$, $m_I$, controller 215 places the circuit of FIG. 2 in a wait state as per box 303.

The frame excitation code and the frame redundancy parameter signals from the processor of FIG. 2 are supplied via input-output interface 260 to coders 131 and 155 in FIG. 1 as is well known in the art. Coders 131 and 155 are operative as previously mentioned to quantize and format the excitation code and the redundancy parameter signals for application to utilization device 148. The $a_k$ prediction parameter signals of the frame are applied to one input of multiplexer 135 through delay 133 so that the frame excitation code from coder 131 may be appropriately multiplexed therewith.

Utilization device 148 may be a communication system, the message store of a voice storage arrangement, or apparatus adapted to store a complete message or vocabulary of prescribed message units, e.g., words, phonemes, etc., for use in speech synthesizers. Whatever the message unit, the resulting sequence of frame codes from circuit 120 are forwarded via utilization device 148 to a speech synthesizer such as that shown in FIG. 5. The synthesizer, in turn, utilizes the frame excitation and redundance parameter signal codes from circuit 120 as well as the frame predictive parameter codes to construct a replica of the speech pattern.

Demultiplexer 502 in FIG. 5 separates the excitation code EC, the redundancy parameter codes $\gamma$, M*, and the prediction parameters $a_k$ of each successive frame. The excitation code, after being decoded into an excitation pulse sequence in decoder 505, is applied to one input of summing circuit 511 in excitation signal former 510. The $\gamma$, M* signals produced in decoder 506 are supplied to predictive filter 513 in excitation signal former 510. The predictive filter is operative as is well known in the art to combine the output of summer 511 with signals $\gamma$ and M* to generate the excitation pulse sequence of the frame. The transfer function of filter 513 is $$p(z)=\gamma z^{-M^*} \tag{15}$$

Signal M* operates to delay the redundancy reduced excitation pulse sequence and signal $\gamma$ operates to modify the magnitudes of the redundancy reduced excitation pulses so that the frame multipulse excitation signal is reconstituted at the output of excitation signal former 510.

The frame excitation pulse sequence from the output of excitation signal former 510 is applied to the excitation input of speech synthesizer filter 514. The $a_k$ predictive parameter signals decoded in decoder 508 are supplied to the parameter inputs of filter 514. Filter 514 is operative in response to the excitation and predictive parameter signals to form a digitally encoded replica of the frame speech signal as is well known in the art. D/A converter 516 is adapted to transform the coded replica into an analog signal which is passed through low-pass filter 518 and transformed into a speech pattern by transducer 520.

The invention has been described with reference to particular illustrative embodiments. It is apparent to those skilled in the art that various modifications may be made without departing from the scope and the spirit of the invention. For example, the embodiments described herein have utilized linear predictive parameters and a predictive residual. the linear predictive parameters may be replaced by formant parameters or other speech parameters well known in the art.

APPENDIX A.

```
c+++     **** Predictive Filter Processor ****
c+++                    box 201

      Subroutine BOX201

      common ym(12),y(80),yo(20),
     &yhatm(12),yhat(80),yhato(20),
     &d(80),v(280),zp(80),yp(80),
     &a(12),b(12),h(20),gamma,mper,beta(10),m(10),imax

      dimension ytemp(112)
      equivalence (ytemp,ym)

      data nlpc/12/,nmax/112/,alpha/0.85/,kmax/20/,mmin/40/

c+++   Compute Coefficients for the Predictive Filter

      g=1
      do101k=1,nlpc
      g=g*alpha
  101 b(k)=g*a(k)

c+++    Generate y Signal

      do102n=1,100
      sm=0
      do103k=1,nlpc
  103 sm=sm+b(k)*ytemp(n+nlpc-k)
  102 ytemp(n+nlpc)=sm
```

```
      return
      end
c+++      ****    Multiframe Correlation Processor *****
c+++                          box 212

      Subroutine BOX212

      common ym(12),y(80),yo(20),
     &yhatm(12),yhat(80),yhato(20),
     &d(80),v(280),zp(80),yp(80),
     &a(12),b(12),h(20),gamma,mper,beta(10),m(10),imax

      dimension z(100)
      equivalence (z,yhat)

      data nlpc/12/,nmax/112/,alpha/0.85/,kmax/20/,mmin/40/

c+++   Generate Predictive Filter Memory Signal

      do104n=1,100
      z(n)=0
      do104i=1,nlpc
  104 z(n)=z(n)+b(i)*z(n-i)

c+++   Initialize mper estar v
      mper=mmin
      estar=0
      call copy(d,v(201),80)

  150 continue


c+++   Generate Periodic Component Signal
c+++   Compute Correlation Between Periodic Component
c+++     and Difference Signal 'y-z'

      en=0
      ed=0
```

```
      do107n=1,80
      sm=0
      do106k=1,kmax
  106 sm=sm+h(k)*v(n+200-mper-(k-1))
      zp(n)=sm
      en=en+(y(n)-z(n))*zp(n)
      ed=ed+zp(n)**2
  107 continue

c+++   Find Minimum Error

      e=-en*en/ed
      if(e.ge.estar)goto140

      mstar=mper
      estar=e

  140 continue
      mper=mper+1
      if(mper.le.mmin+80)goto150


c+++   Generate Periodic Component Signal zp

      en=0
      ed=0
      do109n=1,80
      sm=0
      do108k=1,kmax
  108 sm=sm+h(k)*v(n+200-mstar-(k-1))
      zp(n)=sm
      en=en+(y(n)-z(n))*zp(n)
      ed=ed+zp(n)**2
  109 continue

c+++   Compute gamma  mper

      gamma=en/ed
```

```
      mper=mstar

c+++   Compute Periodic Component yp

      call scale(zp,gamma,yp,80)

      return
      end

      Subroutine COPY (x,y,n)
      dimension x(n),y(n)
      do1i=1,n
    1 y(i)=x(i)
      return
      end

      Subroutine SCALE (x,a,y,n)
      dimension x(n),y(n)
      do2i=1,n
    2 y(i)=a*x(i)
      return
      end
c+++      **** Frame Correlation Signal Processor ****
c+++                        box 217

      Subroutine BOX217

      common ym(12),y(80),yo(20),
     &yhatm(12),yhat(80),yhato(20),
     &d(80),v(280),zp(80),yp(80),
     &a(12),b(12),h(20),gamma,mper,beta(10),m(10),imax

      dimension ci(100)
      dimension z(100)
      equivalence (z,yhat)
      integer q,qmax,qstar

      data nlpc/12/,nmax/112/,alpha/0.85/,kmax/20/,mmin/40/
```

```
      imax=12

c+++   Compute Impulse Response of the Predictive Filter
      h(1)=1
      do103k=2,kmax
      h(k)=0
      do102i=min0(k-1,nlpc)
  102 h(k)=h(k)+b(i)*h(k-i)
      sumsqh=sumsqh+h(k)**2
  103 continue

c+++   Generate Periodic Component

      call BOX212


c+++   Set Initial Excitation Signal Count
      i=1
      q=1

      do181n=1,100
  181 ci(n)=0

c+++   Generate Initial yhat Signal

      do182n=1,80
  182 yhat(n)=z(n)+yp(n)

  500 q=1
  200 continue

c+++   Compute Correlation Signal

      do201n=q,100
  201 ci(q)=ci(q)+(y(n)-yhat(n))*h(n-(q-1))

      q=q+1
```

```
      if(q.le.qmax)goto200

c+++   Find Peak of Correlation Signal

      q=1
      qstar=0
      ciqstar=0

  300 if(abs(ci(q)).lt.abs(ciqstar))goto301
      qstar=q
      ciqstar=ci(q)


  301 q=q+1
      if(q.le.qmax)goto300

      m(i)=qstar
      beta(i)=ciqstar/sumsqh

      do203k=m(i),m(i)+kmax-1
  203 yhat(k)=yhat(k)+beta(i)*h(k-m(i)+1)

      i=i+1
      if(i.le.imax)goto500


      return
      end
c+++      *****  Excitation Signal Processor *****
c+++                        box 205


      Subroutine BOX205

      common ym(12),y(80),yo(20),
     &yhatm(12),yhat(80),yhato(20),
     &d(80),v(280),zp(80),yp(80),
     &a(12),b(12),h(20),gamma,mper,beta(10),m(10),imax
```

```
      data nlpc/12/,nmax/112/,alpha/0.85/,kmax/20/,mmin/40/

c+++   Generate Periodic Component in the Excitation Signal 'v'

      do101n=201,280
  101 v(n)=gamma*v(n-mper)

c+++   Add the Multi-Pulse Part to the Excitation

      do102i=1,imax
      if(m(i).gt.80)goto102
      v(200+m(i))=v(200+m(i))+beta(i)
  102 continue
      return
      end
```

What is claimed is:

1. A method for generating multipulse excitation codes for a speech pattern comprising the steps of:

partitioning a speech pattern into successive time frame portions;

generating a set of predictive parameter signals representative of the speech pattern portion of each successive time frame;

producing a signal representative of the predictive residual of each successive time frame speech pattern portion responsive to the time frame speech parameter signals and time frame speech pattern portion; and generating a multipulse excitation code having a sequence of $n=1, 2, \ldots, N$ pulses for each successive time frame to provide prescribed coded speech pattern quality where N is substantially independent of the pitch of the speech pattern by iteratively forming pulses for said time frame, each pulse having a magnitude $\beta$ and a location m within the frame in N successive iterations and each successive iteration including the steps of;

combining said time frame predictive parameter signals with said time frame predictive residual signals to form a signal y(n) corresponding to the time frame speech pattern portion, combining the excitation pulse sequence of the preceding iteration with said time frame predictive parameter signals to form a signal z(n) corresponding to the contribution of the preceding iteration excitation pulse sequence to the time frame speech pattern portion, forming a signal representative of the differences between said signal y(n) corresponding to the time frame speech pattern portion and said signal z(n) corresponding to the contribution of the preceding iteration excitation pulse sequence to the time frame speech pattern portion, comparing the current time frame signal representative of the differences between the signal y(n) corresponding to the time frame speech pattern portion and said signal z(n) corresponding to the contribution of the preceding iteration excitation pulse sequence to the time frame speech pattern portion with the signal of prescribed preceding time frames representative of the differences between said signal y(n) corresponding to the preceding time frame speech pattern portion and said signal z(n) corresponding to the contribution of the preceding iteration excitation pulse sequence to the preceding time frame speech pattern portion to generate a signal $y_p(n)$ representative of speech pattern portions of said preceding time frames having a predetermined degree of similarity to the speech pattern portion of the time frame, and producing an excitation pulse of magnitude $\beta$ and location m for the present iteration responsive to the differences between said speech pattern portion representative signal y(n) and the sum of said signal representative of the contribution of the preceding iteration excitation pulse sequence to the time frame speech pattern portion and said signal $y_p(n)$ representative of similar speech pattern portions of said preceding time frames.

2. A method for generating multipulse excitation codes for a speech pattern according to claim 1 further comprising the step of utilizing said frame multiphase excitation code and said frame predictive parameter signals to construct a replica of said frame speech pattern.

3. Apparatus for generating multipulse excitation codes for a speech pattern comprising:

means for partitioning a speech pattern into successive time frame portions;

means for generating a set of predictive parameter signals representative of the speech pattern portion of each successive time frame;

means responsive to the time frame speech parameter signals and time frame speech pattern portion for producing a signal representative of the predictive residual of each successive time frame speech pattern portion; and means for iteratively forming a sequence of $n=1, 2, \ldots N$ pulses for said time frame, each pulse having a magnitude $\beta$ and a location m within the frame where N is substantially independent of the pitch of the speech pattern to generate a multiphase excitation code for each successive time frame to provide prescribed coded speech pattern quality;

said iteratively pulse sequence forming means comprises means for generating the nth pulse of said sequence including;

means for combining said time frame predictive parameter signals with said time frame predictive residual signal to form a signal y(n) corresponding to the time frame speech pattern portion, means for combining the excitation pulse sequence of the preceding iteration with said time frame predictive parameter signals to form a signal z(n) corresponding to the contribution of the preceding iteration excitation pulse sequence to the time frame speech pattern portion, means for forming a signal representative of the differences between said signal y(n) corresponding to the time frame speech pattern portion and said signal z(n) corresponding to the contribution of the preceding iteration excitation pulse sequence to the time frame speech pattern portion, means for comparing the signal of the current time frame representative of the differences between said signal y(n) corresponding to the time frame speech pattern portion and said signal z(n) corresponding to the contribution of the preceding iteration excitation pulse sequence to the time frame speech pattern portion of the current time frame with the signal of prescribed preceding time frames representative of the differences between said signal y(n) corresponding to the preceding time frame speech pattern portion and said signal z(n) corresponding to the contribution of the preceding iteration excitation pulse sequence to the preceding time frame speech pattern portion to generate a signal $y_p(n)$ representative of portions of said preceding time frames having a predetermined degree of similarity to the speech pattern portion of the time frame, means for forming a signal representative of the sum of said signal representative of the contribution of the preceding iteration excitation pulse sequence to the time frame speech pattern portion and said signal $y_p(n)$ representative of similar portions of said preceding time frames, and means responsive to the differences between said speech pattern portion representative signal y(n) and the sum of said signal representative of the contribution of the preceding iteration excitation pulse sequence to the time frame speech pattern portion and said signal $y_p(n)$ representative of similar portions of said preceding time frames for producing an excitation pulse of magnitude $\beta$ and location m for the present iteration.

4. Apparatus for generating multipulse excitation codes for a speech pattern according to claim 3 further comprising means for utilizing said frame multipulse excitation code and said frame predictive parameter signals to construct a replica of said frame speech pattern.

5. A speech processor for producing a speech message comprising:

means for receiving a sequence of speech message time frame signals, each speech time frame signal including a set of predictive speech parameter signals, a first coded excitation signal, and a second coded excitation signal for said time frames;

means for combining said first and second coded excitation signal to form a multipulse speech message excitation representative signal for the frame; and means jointly responsive to said linear predictive frame speech parameter signals and said frame multipulse excitation representative signal for generating a speech pattern corresponding to the speech message;

the first coded excitation signal for said frame being formed by the steps of:

generating a sequence of signals corresponding to successive samples of a speech pattern;

partitioning a speech pattern into successive time frame portions;

generating a set of predictive parameter signals representative of the speech pattern portion of each successive time frame;

producing a signal representative of the predictive residual of each successive time frame speech pattern portion responsive to the time frame speech parameter signals and time frame speech pattern portion; and generating a multipulse excitation code having a sequence of $n=1, 2, \ldots, N$ pulses for each successive time frame to provide prescribed coded speech pattern quality where N is substantially independent of the pitch of the speech pattern by iteratively forming a sequence of pulses for said time frame, each pulse having a magnitude $\beta$ and a location m within the frame in N successive iterations and each successive iteration including the steps of:

combining said time frame predictive parameter signals with said time frame predictive residual signals to form a signal y(n) corresponding to the time frame speech pattern portion, combining the excitation pulse sequence of the preceding iteration with said time frame predictive parameter signals to form a signal z(n) corresponding to the contribution of the preceding iteration excitation pulse sequence to the time frame speech pattern portion, forming a signal representative of the differences between said signal y(n) corresponding to the time frame speech pattern portion and said signal z(n) corresponding to the contribution of the preceding iteration excitation pulse sequence to the time frame speech pattern portion, comparing the current time frame signal representative of the differences between said signal y(n) corresponding to the time frame speech pattern portion and said signal z(n) corresponding to the contribution of the preceding iteration excitation pulse sequence to the time frame speech pattern portion with the signal of prescribed preceding time frames representative of the differences between said signal y(n) corresponding to the preceding time frame speech pattern portion and said signal z(n) corresponding to the contribution of the preceding iteration excitation pulse sequence to the preceding time frame speech pattern portion to generate a signal $y_p(n)$ representative of speech pattern portions of said preceding time frames having a predetermined degree of similarity the speech pattern portion of the time frame, and producing an excitation pulse of magnitude $\beta$ and location m for the present iteration responsive to the differences between said speech pattern portion representative signal y(n) and the sum of said signal representative of the contribution of the preceding iteration excitation pulse sequence to the time frame speech pattern portion and said signal $y_p(n)$ representative of similar speech pattern portions of said preceding time frames.

6. A method for producing a speech message comprising:

receiving a sequence of speech message time frame signals, each speech time frame signal including a set of linear predictive speech parameter signals, a first coded excitation signal, and a second coded excitation signal for said time frame; forming a multipulse speech message excitation representative signal for the frame responsive to said first and second coded excitation signals, and generating a speech pattern corresponding to the speech message jointly responsive to said frame linear speech parameter signals and said frame multipulse excitation representative signal;

the first coded excitation signal for said frame being formed by the steps of:

partitioning a speech pattern into successive time frame portions;

generating a set of predictive parameter signals representative of the speech pattern portion of each successive time frame;

producing a signal representative of the predictive residual of each successive time frame speech pattern portion responsive to the time frame speech parameter signals and time frame speech pattern portion; and generating a multipulse excitation code having a sequence of $n=1, 2, \ldots, N$ pulses for each successive time frame to provide prescribed coded speech pattern quality where N is substantially independent of the pitch of the speech pattern by iteratively forming a sequence of pulses for said time frame, each pulse having a magnitude $\beta$ and a location m within the frame in successive iterations and each successive iteration including the steps of:

combining said time frame predictive parameter signals with said time frame predictive residual signals to form a signal y(n) corresponding to the time frame speech pattern portion, combining the excitation pulse sequence of the preceding iteration with said time frame predictive parameter signals to form a signal z(n) corresponding to the contribution of the preceding iteration excitation pulse sequence to the time frame speech pattern portion, forming a signal representative of the differences between said signal y(n) corresponding to the time frame speech pattern portion and said signal z(n) corresponding to the contribution of the preceding iteration excitation pulse sequence to the time frame speech pattern portion, comparing the current time frame signal representative of the differences between said signal y(n) corresponding to the time frame speech pattern portion and said signal z(n) corresponding to the contribution of the preceding iteration excitation pulse sequence to the time frame speech pattern portion of the current time frame with the signal of prescribed preceding time frames representative of the differences between said signal y(n) corresponding to the preceding time frame speech pattern portion and said signal z(n) corresponding to the contribution of the preceding iteration excitation pulse sequence to the preceding time frame speech pattern portion to generate a signal $y_p(n)$ representative of speech pattern portions of said preceding time frames having a predetermined degree of similarity to the speech pattern portion of the time frame, and producing an excitation pulse of magnitude $\beta$ and location m for the present iteration responsive to the differences between said speech pattern portion representative signal y(n) and the sum of said signal representative of the contribution of the preceding iteration excitation pulse sequence to the time frame speech pattern portion and said signal $y_{p(n)}$ representative of similar speech pattern portions of said preceding time frames.

* * * * *